US008650763B2

(12) United States Patent
Howell et al.

(10) Patent No.: US 8,650,763 B2
(45) **Date of Patent: *Feb. 18, 2014**

(54) SHAVING RAZOR PROVIDING ENHANCED CONTROL DURING SHAVING

(75) Inventors: Daren Mark Howell, Winchester (GB); David John O'Callaghan, Reading (GB); Andrew Martin Whittingham, Reading (GB)

(73) Assignee: The Gillette Company, Boston, MA (US)

( * ) Notice: Subject to any disclaimer, the term of this patent is extended or adjusted under 35 U.S.C. 154(b) by 358 days.

This patent is subject to a terminal disclaimer.

(21) Appl. No.: 12/908,473

(22) Filed: Oct. 20, 2010

(65) Prior Publication Data

US 2012/0096718 A1 Apr. 26, 2012

(51) Int. Cl.
*B26B 21/14* (2006.01)
*B26B 21/52* (2006.01)

(52) U.S. Cl.
USPC ..... 30/531; 30/50; 30/527

(58) Field of Classification Search
USPC ..... 30/50, 527, 531
See application file for complete search history.

(56) References Cited

U.S. PATENT DOCUMENTS

| | | | | |
|---|---|---|---|---|
| 4,970,784 | A | 11/1990 | Althaus et al. | |
| 5,661,907 | A | 9/1997 | Apprille, Jr. | |
| 5,687,485 | A | 11/1997 | Shurtleff et al. | |
| 5,787,586 | A * | 8/1998 | Apprille et al. | 30/47 |
| 6,115,924 | A * | 9/2000 | Oldroyd | 30/527 |
| 6,161,288 | A | 12/2000 | Andrews | |
| 6,223,442 | B1 * | 5/2001 | Pina | 30/527 |
| 6,807,739 | B2 | 10/2004 | Follo | |
| D502,291 | S | 2/2005 | King | |
| 7,100,284 | B2 | 9/2006 | King | |
| 7,137,205 | B2 * | 11/2006 | Royle | 30/527 |
| 7,168,173 | B2 * | 1/2007 | Worrick, III | 30/527 |
| 7,197,825 | B2 * | 4/2007 | Walker et al. | 30/77 |
| 7,331,107 | B2 | 2/2008 | Follo et al. | |
| 7,574,809 | B2 * | 8/2009 | Follo et al. | 30/527 |
| 7,669,335 | B2 * | 3/2010 | Walker et al. | 30/34.1 |
| 7,669,511 | B2 | 3/2010 | King | |
| 7,895,754 | B2 * | 3/2011 | Blackburn | 30/58 |
| 7,913,393 | B2 * | 3/2011 | Royle et al. | 30/50 |
| 8,104,184 | B2 * | 1/2012 | Walker | 30/527 |
| 2004/0177518 | A1 | 9/2004 | Leventhal | |
| 2005/0241162 | A1 * | 11/2005 | Nicolosi et al. | 30/531 |
| 2007/0193042 | A1 * | 8/2007 | Worrick et al. | 30/527 |
| 2008/0168657 | A1 | 7/2008 | Cloke et al. | |
| 2009/0113715 | A1 * | 5/2009 | Goss-Melendez | 30/50 |
| 2012/0084984 | A1 * | 4/2012 | Davis | 30/50 |
| 2012/0096718 | A1 * | 4/2012 | Howell et al. | 30/77 |

(Continued)

FOREIGN PATENT DOCUMENTS

| | | |
|---|---|---|
| JP | 4 022388 A | 1/1992 |
| WO | WO 2009/066218 | 5/2009 |

*Primary Examiner* — Hwei C Payer
(74) *Attorney, Agent, or Firm* — Jay A. Krebs

(57) ABSTRACT

A shaving razor that improves stability, corresponding user control and offers a closer shave is provided. The shaving razor can include a razor handle configuration that reduces the propensity for the shaving razor to roll in a user's hand and improves the maneuverability of the razor cartridge during shaving. In addition, the shaving razor can include a biasing pivoting member producing a progressively increasing return torque on the razor cartridge that forces the cartridge into flat contact with the skin thus improving glide and shaving closeness.

16 Claims, 15 Drawing Sheets

(56) References Cited

U.S. PATENT DOCUMENTS

2012/0096722 A1* 4/2012 Howell et al. ..... 30/531
2012/0096723 A1* 4/2012 Howell et al. ..... 30/531
2012/0124840 A1* 5/2012 Iaccarino et al. ..... 30/50

* cited by examiner

SHAVING RAZOR PROVIDING ENHANCED CONTROL DURING SHAVING

FIELD OF THE INVENTION

The present invention relates to shaving razors and particularly to shaving razors including a handle geometry that provides the user with enhanced control of the handle while shaving.

BACKGROUND OF THE INVENTION

This invention relates to a wet shaving razor comprising a cartridge that includes a shaving blade with a cutting edge which is moved across the surface of the skin being shaved by means of an adjoining handle. Conventional safety razors have a blade unit connected to a handle for a pivotal movement about pivotal axis which is substantially parallel to the blade or the blade edge. For example, U.S. Pat. Nos. 7,197,825 and 5,787,586 disclose such a razor having a blade unit capable of a pivotal movement about a pivot axis substantially parallel to the blade(s). The pivotal movement about the single axis provides some degree of conformance with the skin allowing the blade unit to follow the skin contours of a user during shaving. Such safety razors have been successfully marketed for many years. However, the blade unit can fail to remain flat and often disengages from the skin during shaving due to the blade unit's limited ability to pivot about the single axis combined with the dexterity required to control and maneuver the razor handle. The combination of these deficiencies can affect the glide and overall comfort during shaving.

There have been various proposals for mounting a cartridge on a handle to enable movement of the cartridge during shaving with the aim of maintaining conformity of the skin contacting parts with the skin surface during shaving. For example, many razors currently marketed have cartridges which are pivotable about longitudinal axes extending parallel to the cutting edges of the elongate blades incorporated in the cartridges. There is an increasing need to provide a shaving consumer with a closer, more effective shave. Applicant has attempted to provide this in its commercially available Fusion® razor which incorporates a spring in its following system to bring about a reduced cartridge to skin angle, which has been found to lead to a better shave. Similarly, others have attempted to manipulate the biasing mechanisms of their commercial razors. For instance, US Patent Publication 2005/0241162 A1 discloses a biasing assembly for a wet shave razor wherein the assembly includes 1) an abutment surface defined by a cartridge and located on the underside of the cartridge and 2) a biasing member extending outwardly from the handle and having an end which when the cartridge is coupled to the handle is in sliding engagement between the neutral and fully-rotated positions. The biasing member exerts a variable torque against the abutment surface. The reference, however, focuses primarily on a low spring force to prevent the cartridge from lifting off of the skin and does not focus on the effect that the biasing member has on maintaining the cartridge flat relative to the skin during shaving strokes and corresponding shaving closeness.

In addition, current shaving razors 10 found on the market typically include handle configurations that are variations of an 'L' shape where the longitudinal axis 30 of the handle 14 is offset from the razor cartridge 12 such that it intersects the cutting plane 122 behind the cartridge 12 as shown in FIG. 1. This configuration has the effect of pushing the razor cartridge 12 through the shaving stroke which can make it difficult to maneuver and can require a steady hand to steer the razor cartridge 12. In addition, the shaving razors have an axis of roll 36 (interchangeably referred to hereinafter as axis of roll 36 and handle roll axis 36) that extends between the free end of the handle 14 and a point on the cartridge where the forces are balanced. The axis of roll 36 is the line about which the razors spin in the direction shown in FIG. 1 when in a user's hand. For the L-shape configuration shown, this arrangement has a shortcoming. Since the handle longitudinal axis 30 extends above the axis of roll 36, instability is introduced during shaving, similar to a top heavy scenario that a user must compensate for when handling the razor. Hence, additional effort is required by the user to maintain stability of the razor during shaving.

In pursuit of an improved shaving product, there is a need for a shaving razor that can maintain the blade unit of a razor cartridge flat against the skin throughout a shaving stroke. Particularly there is a need for a shaving razor having a biasing member producing a progressively increasing return torque on a cartridge forcing the cartridge into contact with the skin throughout the shaving stroke. In addition, there is a need for a handle geometry that provides the user with improved control while shaving.

SUMMARY OF THE INVENTION

In one aspect, the invention features, in general, a shaving razor including a handle geometry that provides a user with enhanced control while shaving. The shaving razor comprises a cartridge. The cartridge comprises a cartridge housing having a front edge portion, a rear edge portion and two opposing side edge portions extending from the front edge portion to the rear edge portion. One or more shaving blades are disposed between the front edge portion and the rear edge portion. A cutting plane is tangent to the rear edge portion and the front edge portion of the cartridge housing with a forward cutting direction toward the front edge portion of the cartridge. The handle comprises a forward portion comprising a cartridge mounting structure that releasably mounts to the cartridge; a rear portion opposite the forward portion comprising a free end; and an elongate central portion disposed between the forward portion and the rear portion. The elongate central portion includes an upper surface and a lower surface and a longitudinal axis disposed therebetween. A projection of the longitudinal axis of the elongate central portion of the handle intersects the cutting plane at a point of intersection that leads a point of equilibrium on the razor cartridge in the cutting direction. In one embodiment the point of intersection leads the point of equilibrium in the cutting direction by a distance ranging from about 0 mm to about 10 mm.

In alternate embodiment, the shaving razor includes a handle roll axis extending between the point of equilibrium and the free end of the rear portion of the handle and a handle load point on the upper surface of the elongate central portion proximate the forward portion. The handle load point is the location where forces are applied to the handle to steer the cartridge during use. The handle roll axis either intersects or is less than 5 mm below the handle load point.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in conjunction with the accompanying drawings.

DETAILED DESCRIPTION OF THE INVENTION

The shaving razor according to the present invention will be described with reference to the following figures which illustrate certain embodiments. It will be apparent to those skilled in the art that these embodiments do not represent the full scope of the invention which is broadly applicable in the form of variations and equivalents as may be embraced by the claims appended hereto. Furthermore, features described or illustrated as part of one embodiment may be used with another embodiment to yield still a further embodiment. It is intended that the scope of the claims extend to all such variations and equivalents.

The present invention provides a wet shaving razor that improves stability and corresponding user control of a shaving razor and provides an improved closer shave to skin covered with hair. The wet shaving razor according to the present invention includes a biasing member that produces a progressively increasing return torque (interchangeably referred to "as progressively increasing return torque" and "progressively increasing torque") that forces the cartridge into flat contact with the skin during shaving thereby reducing the angle between the cartridge and the skin which improves glide and shaving closeness. In addition, the wet shaving razor includes a razor handle configuration which reduces the propensity for the shaving razor to roll or spin in a user's hand and improves the maneuverability of the shaving razor during shaving. These and other features of the shaving razor are further described below.

Figure 2A:
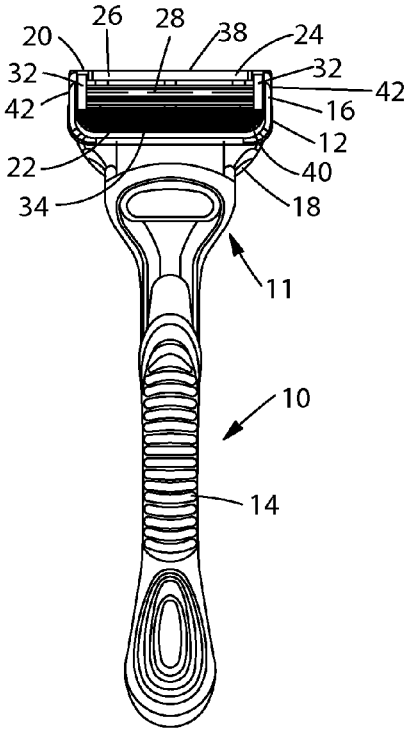
FIG. 2A is a bottom view of a shaving razor.
Figure 2B:
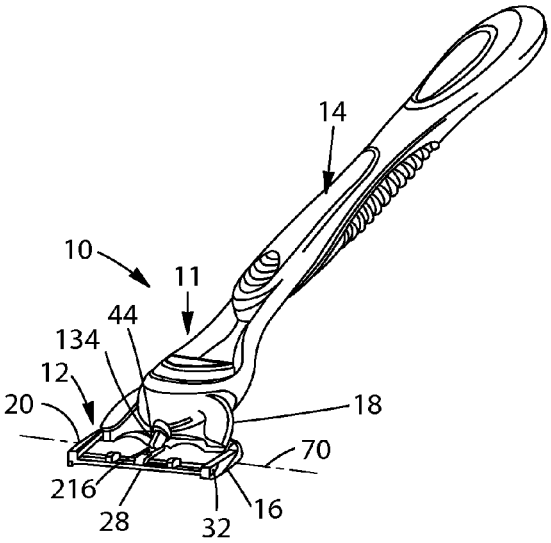
FIG. 2B is a perspective view of a shaving razor.

Referring to FIG. 2A and FIG. 2B, the shaving razor 10 includes disposable cartridge 12 and handle 14. Cartridge 12 includes a connecting member 18, which removably connects the blade unit 16 to a handle connecting structure 11 on handle 14. The blade unit 16 is pivotally connected to the connecting member 18. Blade unit 16 includes plastic housing 20, primary guard 22 at a front edge portion 40 of housing 20 and cap 24 at a rear edge portion 38 of housing 20. The guard 22 may have a plurality of fins 34 spaced apart from each other that extend longitudinally along a length of the housing 20. The cap 24 may have a lubricating strip 26. Two opposing side edge portions 42 extend between the front edge portion 40 and the rear edge portion 38. One or more elongated shaving blades 28 are positioned between the guard 22 and cap 24. Although five shaving blades 28 are shown, it is understood that more or less shaving blades 28 may be mounted within the housing 20. The blades 28 are shown secured within the housing 20 with clips 32; however, other assembly methods known to those skilled in the art may also be used. These and other features of shaving razor 10 are described in U.S. Pat. No. 7,168,173.

In a forward pivoting razor system like the one shown in FIG. 2A and FIG. 2B, a high peak torque will force the cartridge further into the skin which is desirable for increased contact. However, when a high peak torque has been achieved in existing razor systems this has given rise to a high initial torque or steep initial gradient. Consumer testing shows that a high initial torque is unfavourable and leads to a reduction in control benefits which outweigh any other gains. The present invention overcomes this by carefully controlling component tolerances to deliver a return torque that progressively increases such that it begins low and ends high with a shallow gradient. The return torque is the torque resulting from forces exerted on the cartridge by a biasing member as the cartridge pivots, forcing it to return to its neutral position. The progressively increasing return torque forces the cartridge into flat contact with the skin as the cartridge pivots, thus improving glide and shaving closeness.

Figure 3:
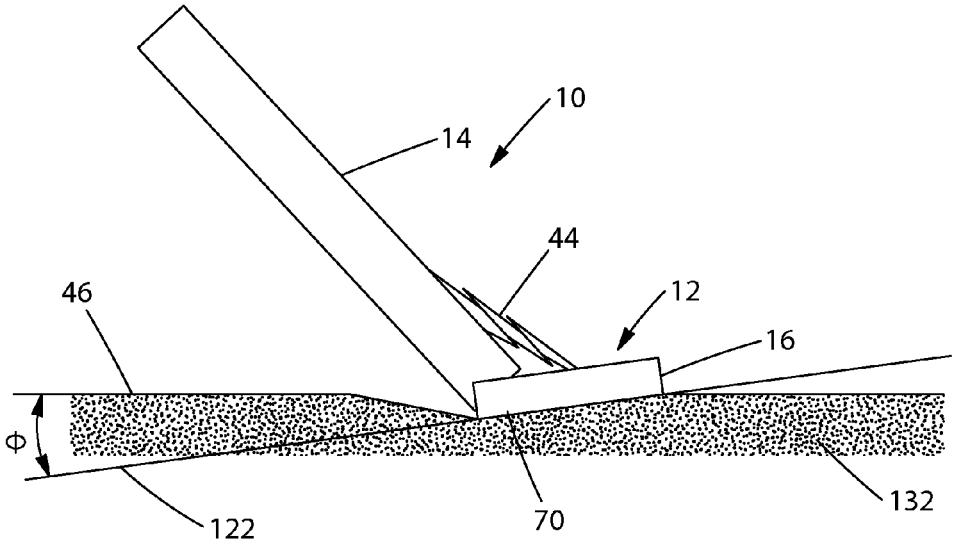
FIG. 3 is a side view of a shaving razor showing the biasing member and defining the cartridge to skin angle, Φ.
Figure 4:
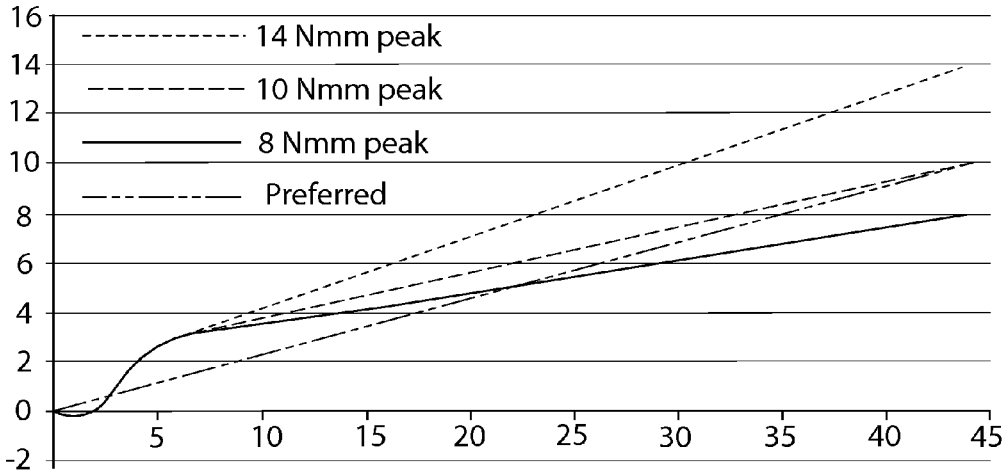
FIG. 4 is a graph showing plots of progressively increasing return torques produced by biasing members.
Figure 5A:
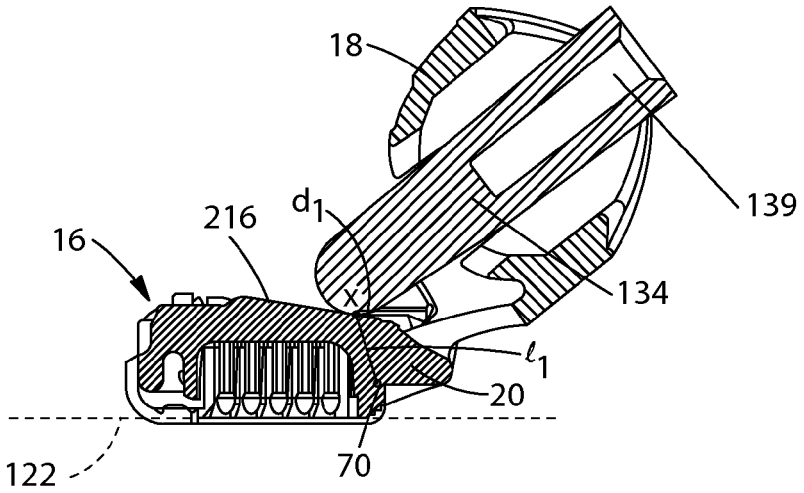
FIG. 5A is a side view of a razor cartridge in FIG. 2B in an at rest position.
Figure 5B:
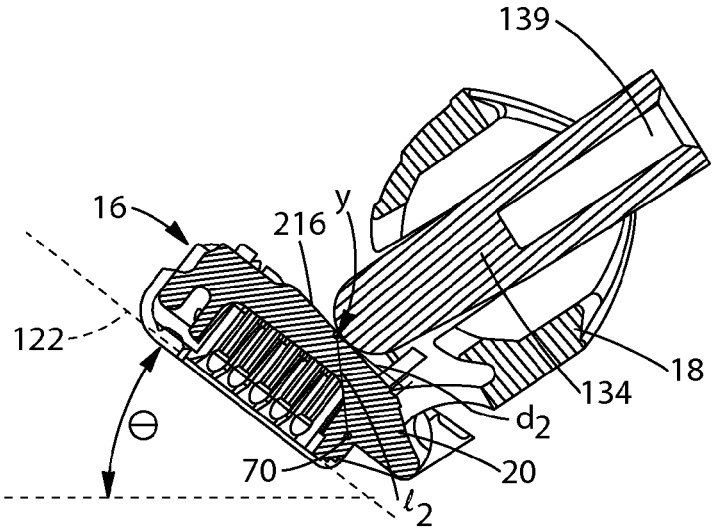
FIG. 5B is a section view of the cartridge of FIG. 2B in the fully rotated position.

The wet shaving razor of the present invention is able to provide an improved closer shave to skin covered with hair by forcing the blade unit 16 of a razor cartridge 12 into a more even contact with the skin with a progressively increasing return torque in order to minimize the cartridge to skin angle throughout a shaving stroke. As shown in FIG. 3, cartridge to skin angle Φ is defined as the angle between the cartridge major axis in the shaving direction which is an axis which is tangent to the cutting plane 122 of the cartridge (also known as the blade tangent line) and the skin 132 tangent line 46. Minimizing the cartridge to skin angle Φ has been found to improve glide and shaving closeness making it an important measure of razor performance. To achieve this, the shaving razor 10 of the present invention can include a biasing member 44 capable of inducing a progressively increasing return torque on the razor cartridge 12 as it pivots about the cartridge pivot axis 70. Examples of progressively increasing return torque profiles are illustrated in FIG. 4. The data for the return torque profiles is provided in Table I below. Cartridge pivot angle is the angle θ that the cartridge pivots from a neutral or at rest position as shown in FIG. 5A to a pivoted position as shown in FIG. 5B.

TABLE I

| Cartridge Pivot | | Torque (Nmm) | | | |
|---|---|---|---|---|---|
| Angle (deg) | Gradient Nmm/Deg | 14 Nmm Peak | 10 Nmm Peak | 8 Nmm Peak | Preferred |
| 0 | <1 | 0 | 0 | 0 | 0 |
| 2 | <1 | 0 | 0 | 0 | .45 |
| 4 | <1 | 2 | 2 | 2 | .91 |
| 6 | <1 | 3 | 3 | 3 | 1.36 |
| 8 | <0.3 | 3.6 | 3.4 | 3.3 | 1.82 |
| 10 | <0.3 | 4.2 | 3.7 | 3.5 | 2.27 |
| 12 | <0.3 | 4.7 | 4.1 | 3.8 | 2.73 |
| 14 | <0.3 | 5.3 | 4.5 | 4.1 | 3.18 |
| 16 | <0.3 | 5.9 | 4.8 | 4.3 | 3.64 |
| 18 | <0.3 | 6.5 | 5.2 | 4.6 | 4.09 |
| 20 | <0.3 | 7.1 | 5.6 | 4.8 | 4.55 |
| 22 | <0.3 | 7.6 | 5.9 | 5.1 | 5.00 |
| 24 | <0.3 | 8.2 | 6.3 | 5.4 | 5.45 |
| 26 | <0.3 | 8.8 | 6.7 | 5.6 | 5.91 |
| 28 | <0.3 | 9.4 | 7.1 | 5.9 | 6.36 |
| 30 | <0.3 | 9.9 | 7.4 | 6.2 | 6.82 |
| 32 | <0.3 | 10.5 | 7.8 | 6.4 | 7.27 |
| 34 | <0.3 | 11.1 | 8.2 | 6.7 | 7.73 |
| 36 | <0.3 | 11.7 | 8.5 | 6.9 | 8.18 |
| 38 | <0.3 | 12.3 | 8.9 | 7.2 | 8.64 |
| 40 | <0.3 | 12.8 | 9.3 | 7.5 | 9.09 |
| 42 | <0.3 | 13.4 | 9.6 | 7.7 | 9.55 |
| 44 | <0.3 | 14 | 10 | 8 | 10.0 |

As shown in FIG. 4, plots of progressively increasing return torque curves are provided for three embodiments exhibiting peak torques of 8 Nmm, 10 Nmm and 14 Nmm respectively. For each curve the minimum torque exhibited by the biasing member 44 in the neutral position is 0 Nmm indicating that the biasing member 44 is neither under compression nor tension in the relaxed state when no force is exerted on the cartridge 12. The gradient represented by the slopes of each of the curves is less than 1.0 Nmm/degree for the first 6 degrees of pivot rotation and less than 0.3 Nmm/degree from 6° to 40° of pivot rotation. Preferably, the cartridge 12 exhibits a progressively increasing return torque ranging from an initial torque of 0 Nmm at about 0° cartridge rotation and a peak torque of 8 Nmm at about 40° cartridge rotation with a gradient of 0.25 Nmm/degree.

Referring to FIG. 2B, the blade unit 16 is biased toward an upright, rest position by a biasing member 44 comprising a spring-biased plunger 134. A rounded distal end of the plunger 134 contacts the cartridge housing at a cam surface 216 at a location spaced from the pivot axis 70 to impart a biasing force to the housing 20. Locating the plunger/housing contact point spaced from the pivot axis 70 provides leverage so that the spring-biased plunger 134 can return the blade unit 16 to its upright, rest position upon load removal. This leverage also enables the blade unit 16 to pivot freely between its upright, neutral position and fully loaded positions in response to a changing load applied by the user.

Referring now to FIGS. 5A and 5B, as the blade unit 16 rotates relative to the handle, the contact point between the plunger 134 and the cam surface 216 changes. The horizontal distance $d_1$ and the direct distance $l_1$ are each at a minimum at point X when the blade unit 16 is at the spring-biased, rest position, with $d_1$ measured along a horizontal line that is perpendicular to the pivot axis 70 and parallel to cutting plane 122. The horizontal distance $d_2$, also measured along a horizontal line that is perpendicular to the pivot axis 70 and parallel to cutting plane 122, and direct distance $l_2$ are each at a maximum at contact point Y when the blade unit 16 is at the fully rotated position. In the embodiment shown, $d_1$ is about 0.9 mm, $l_1$ is about 3 mm, $d_2$ is about 3.5 mm and $l_2$ is about 5 mm. Alternatively, $d_1$ can be between about 0.8 and 1.0 mm, $l_1$ can be between about 2.5 and 3.5 mm, $d_2$ can be between about 3 and 4 mm and $l_2$ can be between about 4.5 and 5.5 mm.

As the blade unit 16 is rotated from its rest position, the torque about the pivot axis due to the force applied by plunger 134 increases due, at least in part, to the increasing horizontal distance between the contact point y and the pivot axis 70 and the rotation of the plunger 134 to a more perpendicular orientation to the cam surface 216. In some embodiments, the minimum torque applied by the spring-biased plunger, e.g., in the rest position, is at least about 1.5 N-mm, such as about 2 N-mm. However, as discussed below preferably, the minimum torque applied by the spring biased plunger 134 in the rest position is 0 Nmm.

Figure 6A:
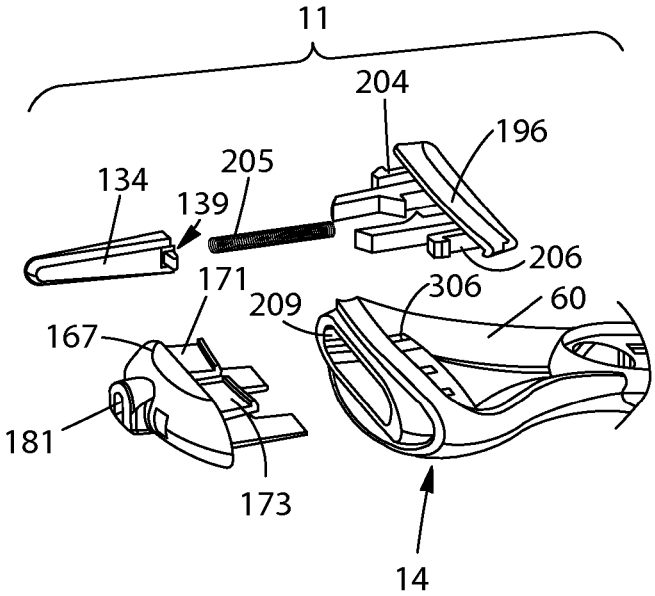
FIG. 6A is a detail view of the components forming the connecting structure of the razor handle in FIG. 2B.
Figure 6B:
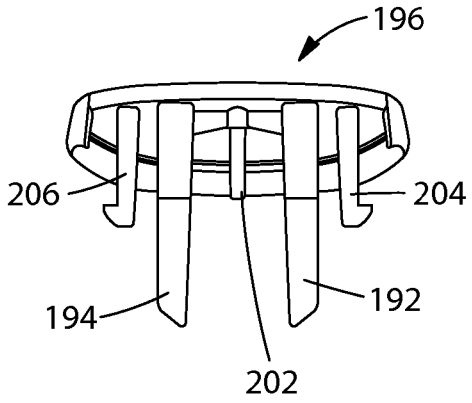
FIG. 6B is a side view of a release button shown in FIG. 6A.

The plunger 134 is biased by a compression spring. Referring to FIG. 5A and FIG. 5B, the plunger 134 includes a cavity 139 formed within a plunger body capable of receiving a spring. Referring now to FIG. 6A and FIG. 6B, to assemble the connecting structure 11 of the handle 14, a tank 167 is inserted into handle forward portion 60 such that latch arms 171 and 173 latch against a surface 306 at forward portion 60 of the handle 14. The spring 205 is placed over the cylindrical extension 202 (FIG. 6B) extending from the release button 196. The spring 205 is also inserted into cavity 139 of the plunger 134. The plunger-spring-button assembly is inserted into the rear portion of the tank 167 such that the plunger 134 is received by slot 181 and the pusher arms 192 and 194 are received by slots in the tank 167. Latch arms 204 and 206 of the release button 196 are set in tracks 209 of the handle 14.

With the embodiment shown in FIGS. 6A and 6B, the connecting structure 11 includes a release button 196, which provides the mechanical ground to the handle 14, the spring 205, which is placed over the cylindrical extension 202 of the release button 196 and the plunger 134. The plunger 134 extends to the cartridge cam surface 216. The base of the plunger is constrained by the slot 181 in tank 167. The spring 205 sits in cavity 139 of the plunger 134. These and other features of shaving razor 10 are described in U.S. Patent Application Publication No. 2007/0193042 A1.

For the compression spring 205 to be relaxed, the dimensions of the aforementioned components must be tightly controlled to ensure the spring is not compressed or tensioned when the cartridge is at rest. For the present invention, the cavity 139 inside the plunger 134 and the overall dimensions of the plunger 134 are important to achieving a relaxed spring if the tank 167, release button 196 and cam surface 216 are unchanged. The compression spring can exhibit a spring stiffness of from about 0.85 N/mm to about 1.13 N/mm with a particular embodiment having a spring stiffness of about 1.02 N/mm. In certain embodiments, the entire length of the spring will be accommodated within the cavity 139 when the spring 205 is under no stress (i.e., no tension or compression). The diameter and length of cavity 139 is relative to the diameter and free length of the spring 205 to create a near zero load. In a certain embodiment, the cavity may be about 6.8 mm in length.

Figure 7:
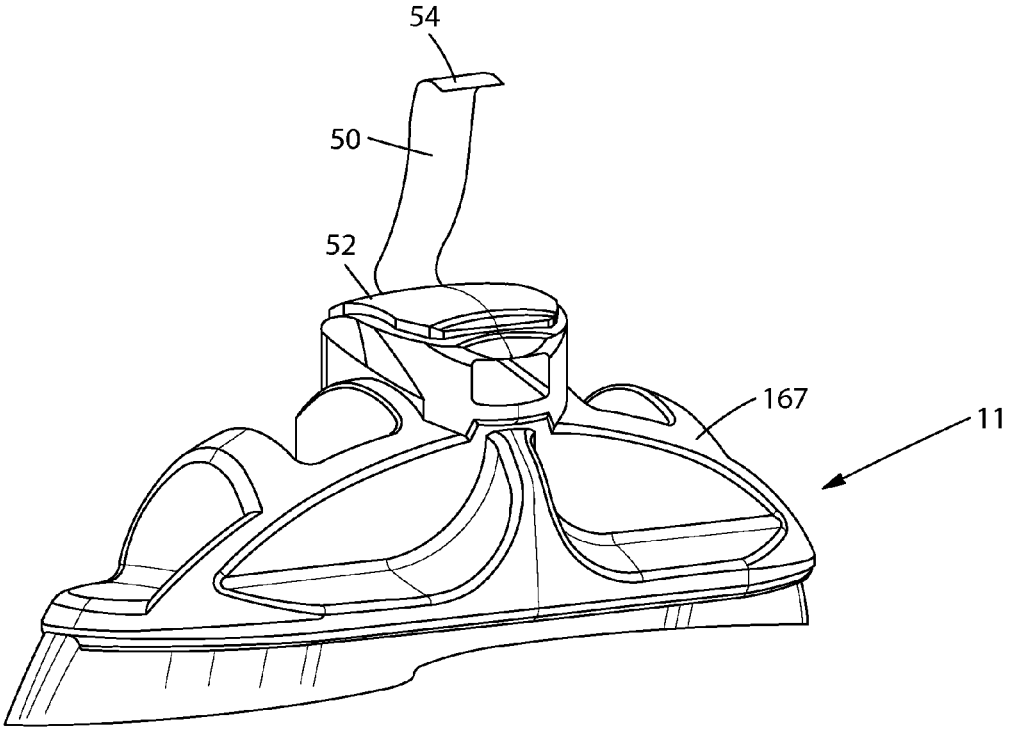
FIG. 7 is a perspective view of a tank of a handle connecting structure including leaf spring biasing member.

In an alternate embodiment, the biasing member can include a leaf spring 50 as described in U.S. Pat. No. 6,223,442 B1. For this embodiment the plunger 134 shown in FIG. 2*b* can be replaced with a leaf spring 50. FIG. 7 illustrates a tank 167 of a handle connecting structure 11 that removably connects the handle 14 to the connecting member 18 on the razor cartridge 12. The handle connecting structure 11 includes a leaf spring 50. The leaf spring 50 includes a first end 52 attached to the tank 167 and a second end 54. The second end 54 is a distal end comprising a free end which interfaces with a cam surface 216 on the shaving razor cartridge 12 shown in FIG. 2B. The leaf spring 50 provides a spring force to bias housing 20 of the shaving razor cartridge 12. The leaf spring can be assembled in a relaxed state so that the initial torque applied on the cartridge is 0 Nmm in the neutral position when the cartridge pivot angle is 0° and can include a spring stiffness that enables the leaf spring 50 to induce a progressively increasing return torque ranging from 0 Nmm to about 14 Nmm through a cartridge pivot angle of rotation about the pivot axis ranging from 0° to 40°.

Other mechanisms providing a biasing member 44 for a razor cartridge 12 can be provided. Such mechanisms include four bar linkages as described in U.S. Pat. Nos. 7,137,205 and 6,115,924. Other biasing members 44 can include torsion springs, diaphragm springs, and live hinges.

Figure 8:
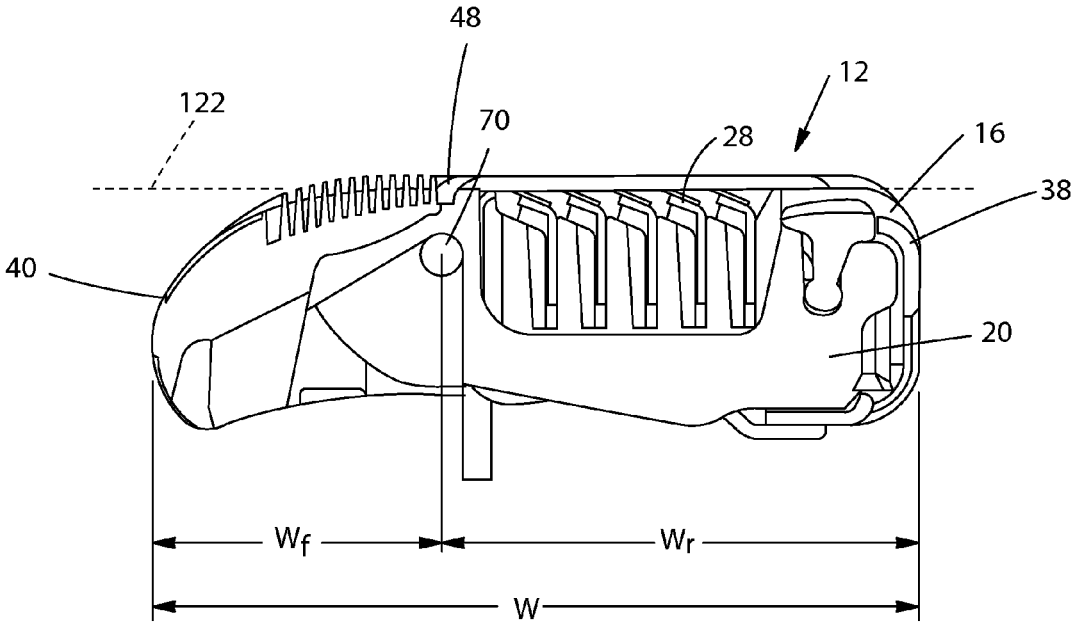
FIG. 8 is a section view of the razor cartridge of FIG. 2B.

Referring now to FIG. 8, the connecting member and housing 20 are connected such that the pivot axis 70 is located below cutting plane 122 (e.g., at a location within the housing 20) and in front of the blades 28. Alternatively, the pivot axis 70 may be aligned with the cutting edge of the first blade in the plurality of blades 28. Positioning the pivot axis 70 in front of the blades 28 is sometimes referred to as a "front pivoting" arrangement.

The position of the pivot axis 70 along the width W of the blade unit 16 determines how the cartridge will pivot about the pivot axis 70, and how pressure applied by the user during shaving will be transmitted to the user's skin and distributed over the surface area of the razor cartridge. For example, if the pivot axis 70 is positioned behind the blades and relatively near to the rear edge 38 of the housing, so that the pivot axis is spaced significantly from the center of the width of the housing 20, the blade unit may tend to exhibit "rock back" when the user applies pressure to the skin through the handle. "Rock back" refers to the tendency of the wider, blade-carrying portion of the blade unit 16 to rock away from the skin as more pressure is applied by the user. Positioning the pivot point 70 in this manner generally results in a safe shave, but may tend to make it more difficult for the user to adjust shaving closeness by varying the applied pressure.

In blade unit 16, the distance between the pivot axis 70 and the front edge 40 of the blade unit 16 is sufficiently long to balance the cartridge about the pivot axis. By balancing the cartridge in this manner, rock back is minimized while still providing the safety benefits of a front pivoting arrangement. Safety is maintained because the additional pressure applied by the user will be relatively uniformly distributed between the blades and the elastomeric member rather than being transmitted primarily to the blades, as would be the case in a center pivoting arrangement (a blade unit having a pivot axis located between the blades). Preferably, the distance from the front of the blade unit to the pivot axis ($W_f$) is sufficiently close to the distance from the rear of the blade unit to the pivot axis ($W_r$) so that pressure applied to the skin through the blade unit 16 is relatively evenly distributed during use. Pressure distribution during shaving can be predicted by computer modeling.

Referring to FIG. 8, the projected distance $W_f$ is relatively close to the projected distance $W_r$. Preferably, $W_f$ is within 45 percent of $W_r$, such as within 35 percent. In some cases, $W_r$ is substantially equal to $W_f$. Preferably, $W_f$ is at least about 3.5 mm, more preferably between 5.5 and 6.5 mm, such as about 6 mm. $W_r$ is generally less than about 11 mm (e.g., between about 11 mm and 9.5 mm, such as about 10 mm).

A measure of cartridge balance is the ratio of the projected distance $W_r$ between the rear edge 38 of the blade unit 16 and the pivot axis 70 to the projected distance W between the front edge 40 and rear edge 38 of the blade unit 16, each projected distance being measured along a line parallel to a housing axis that is perpendicular to the pivot axis 70. The ratio may also be expressed as a percentage termed "percent front weight".

Figure 9:
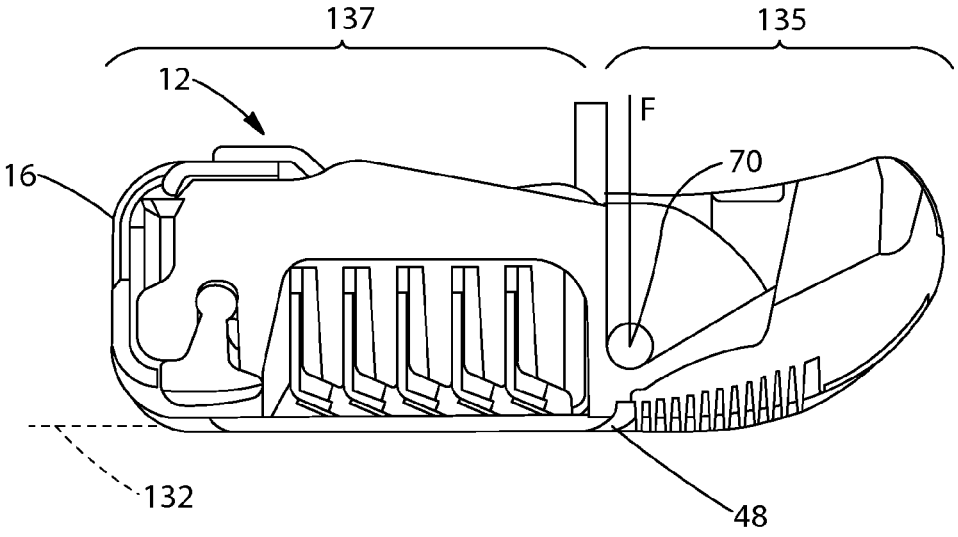
FIG. 9 is a section view of the razor cartridge of FIG. 2B weighted against the skin.

Referring now to FIG. 9, the blade unit 16 is shown weighted against skin 132. Blade unit 16 is weighted by application of a normal force F perpendicular to the pivot axis 70 (i.e., applied through handle 14 by a user and neglecting other forces, such as that applied by the biasing member 44. Preferably, a weight percent (or percent front weight) carried along $W_f$ is at most about 70 percent (e.g., between about 50 percent and about 70 percent, such as about 63 percent) of a total weight carried by the blade unit 16.

By balancing the blade unit 16, the weight carried by the front portion 135 over $W_f$ and rear portion 137 over $W_r$ is more evenly distributed during use, which corresponds to a more even distribution of pressure applied to the shaving surface during shaving. Also, more weight is shifted to the rear portion 137 of the cartridge 12 where the blades 28 are located during use, inhibiting rock back of the rear portion 137, which can provide a closer shave.

The pressure distribution on the blade unit 16 produces a distributed force that can be described as a resultant of forces. The resultant of forces coincides with a point of equilibrium 48 on the razor cartridge 12 which typically separates the front portion $W_f$ and rear portion $W_r$. The point of equilibrium 48 intersects the cutting plane and is preferably aligned with the cartridge pivot axis 70 providing balanced axis of rotation for the shaving razor cartridge 12 about the pivot axis 70.

In addition to a biasing member providing a progressively increasing return torque in order to minimize the cartridge to skin angle throughout a shaving stroke, the shaving razor of the present invention can include a handle configuration that improves stability and corresponding user control of the razor cartridge during shaving. Stability involves the balance of the razor which can be described in terms of static loading applied to the razor configuration. Control involves the ability to steer or guide the razor cartridge which can be described in terms of dynamic loading.

Stability can be classed in three conditions, unconditionally unstable, conditionally stable, and unconditionally stable. In a shaving context, during shaving strokes a razor may be described as unconditionally unstable where the razor handle configuration has a natural imbalance creating a top heavy scenario causing the handle to have a propensity to spin or roll about the handle roll axis when simply supported between the free end of the handle and the point of equilibrium on the cartridge. As a result, an unconditionally unstable razor handle configuration requires more effort to maintain control to overcome the imbalance during use. A conditionally stable razor may include a balanced razor handle configuration such that the razor does not have a propensity to spin or roll when simply supported between the free end of the handle and point of equilibrium on the razor cartridge. An unconditionally stable razor may include a razor handle configuration having a natural imbalance creating a bottom heavy scenario similar to a pendulum. For this configuration, not only does the razor not have a propensity to spin or roll when simply supported between the free end of the handle and point of equilibrium on the razor cartridge, when the simply supported razor is displaced from its equilibrium position the bottom heavy imbalance influenced by a restoring force applied by the user's forefinger easily returns the razor to its equilibrium position.

Figure 10A:
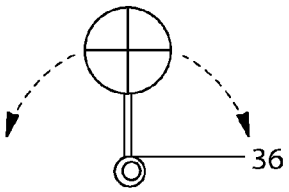
Fig. 10A (Prior Art)
FIG. 10*a* illustrates the effects of the loads applied to the handle configuration in FIG. 10.
Figure 10:
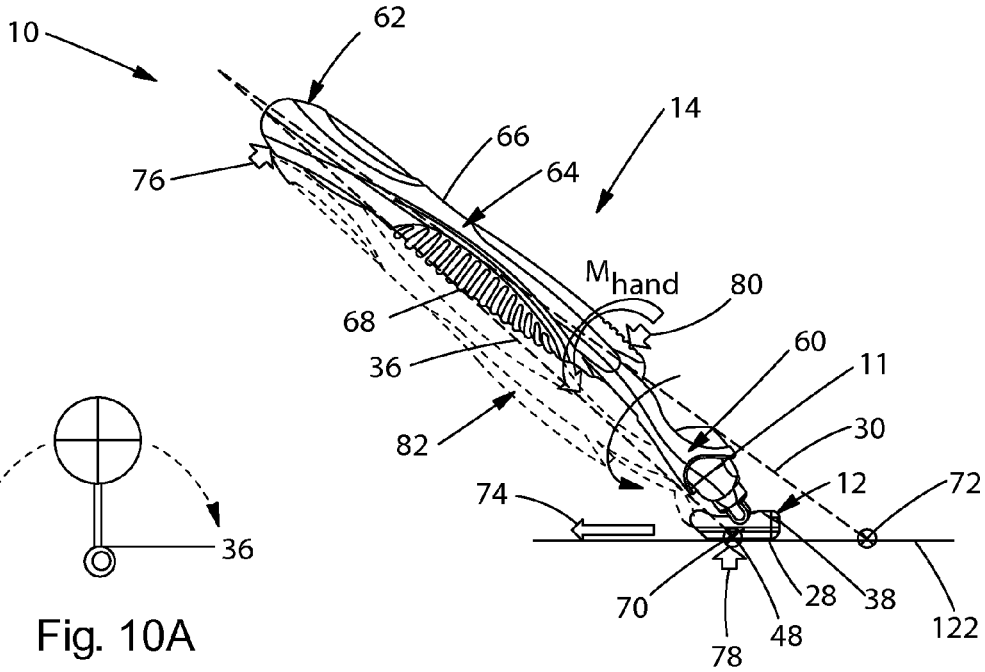
Fig. 10 (Prior Art)
FIG. 10 is a side view of a prior art shaving razor showing load points, handle roll axis and the longitudinal axis of the handle.

FIG. 10 illustrates a prior art handle configuration which is unconditionally unstable. Referring to FIG. 10, handle 14 includes a forward portion 60 comprising a handle mounting structure 11 that releasably mounts to connecting member 18, a rear portion 62 opposite the forward portion comprising a free end and an elongate central portion 64 disposed between the forward portion 60 and the rear portion 62. The forward portion 60 includes a gentle curve at the end that is concave on the same side as the blades 28. The elongate central portion 64 includes an upper surface 66 and a lower surface 68 and a longitudinal axis 30 disposed therebetween. A projection of the longitudinal axis intersects the cutting plane 122. The point of intersection 72 for the razor in FIG. 10 is behind the rear edge portion 38 of the cartridge. The shaving razor cartridge 12 includes a pivot axis 70 and a point of equilibrium 48. The cartridge also includes a cutting plane 122 tangent to the front edge portion 40 and the rear edge portion 38 and a cutting direction 74 toward the front edge portion 40. The point of equilibrium 48 intersects the cutting plane 122. The shaving razor 10 includes an axis of roll 36 (interchangeably referred to hereinafter as axis of roll 36 and handle roll axis 36) extending between the free end of the rear portion 62 of the handle 14 and the point of equilibrium 48 on the razor cartridge 12.

During shaving different users have different ways of gripping the handle. For instance many apply a simply supported grip during use such that the shaving razor includes three simply supported points of contact where loads are applied. As shown in FIG. 10, a first point of contact 76 is at the free end which is supported between the palm of the hand and the fingers that are adjacent the forefinger. A second point of contact 78 is at the point of equilibrium of the razor cartridge where the cartridge is pressed against the user's skin being shaved. The third point of contact is a handle load point 80 on the upper surface 66 proximate the forward portion 60 of the handle. The handle load point 80 is the location where a force is applied by a user's forefinger or by the forefinger and finger adjacent thereto. During use, the direction of the force applied to the handle load point 80 is opposite the direction of the force applied to the first and second points of contact 76, 78. For a simply supported grip, the razor cartridge 12 is predominantly steered by the force applied by the forefinger at the handle load point 80 which also counteracts moments about the handle roll axis 36 induced by forces acting on the razor cartridge 12 during a shaving.

As shown in FIG. 10, since the longitudinal axis 30 of the handle 14 extends above the handle roll axis 36, the handle load point 80 occurs a measured distance above the handle roll axis 36. The measured distance for the embodiment shown in FIG. 10 can be 10 mm or higher. For a simply supported grip, the configuration provides a top heavy scenario illustrated by the analogy shown in FIG. 10*a*. As a result the handle configuration in FIG. 10 has a natural imbalance which creates a propensity to roll or spin about the handle roll axis 36. In addition, forces applied to the handle load point that are not perpendicular to the load point and axis of roll create eccentric loads producing moments that induce roll causing the handle to spin or rotate to the shaded orientation 82 shown in FIG. 10. As a result, the configuration presents an unconditionally unstable configuration since instability due to imbalance and eccentric loads have to be compensated for during use.

Figures 11, 11A:
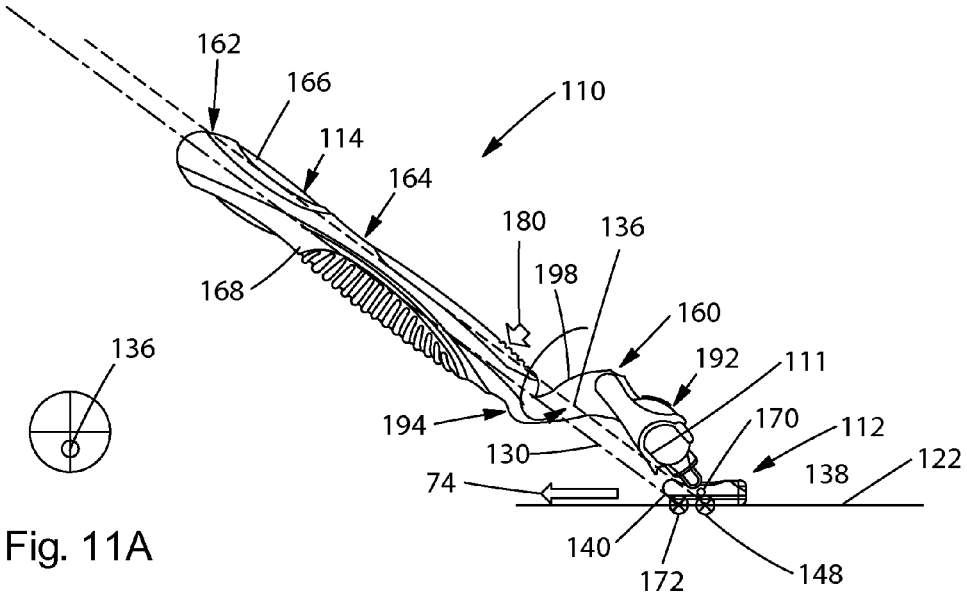
FIG. 11 is a side view of a shaving razor handle configuration showing handle roll axis proximate the handle load point and the projection of the longitudinal axis of the handle intersecting the cutting plane forward of the razor cartridge.
FIG. 11*a* illustrates the effects of loads applied to the handle of FIG. 11.

FIG. 11 illustrates a handle configuration according to the present invention which is conditionally stable. Referring to FIG. 11, shaving razor 110 includes a handle 114 including a forward portion 160 comprising a handle mounting structure 111 that releasably mounts to shaving razor cartridge 112, a rear portion 162 opposite the forward portion 160 comprising a free end and an elongate central portion 164 disposed between the forward portion 160 and the rear portion 162. The elongate central portion 164 includes an upper surface 166 and a lower surface 168 and a longitudinal axis 130 disposed therebetween. The shaving razor cartridge 112 includes a pivot axis 170 and a point of equilibrium 148. The cartridge 112 also includes a cutting plane 122 tangent to the front edge portion 140 and the rear edge portion 138 and a cutting direction 74 toward the front edge portion 140. The point of equilibrium 148 intersects the cutting plane 122. A projection of the longitudinal axis 130 intersects the cutting plane 122 at a point of intersection 172. The point of intersection 172 for the razor configuration in FIG. 11 is forward of the point of equilibrium 148, on or near the front edge portion 140 of the cartridge 112. Preferably, the point of intersection 172 leads the point of equilibrium 148 on the cartridge 112 by less than 10 mm. The shaving razor also includes a handle roll axis 136 extending between the free end of the rear portion 162 of the handle 114 and the point of equilibrium 148 on the razor cartridge 112. For this embodiment, the longitudinal axis 130 can be parallel to the handle roll axis 136. Alternatively, the longitudinal axis 130 can coincide with the handle roll axis 136 such that the point of intersection 172 of the projection of the longitudinal axis 130 is at the point of equilibrium 148.

For the configuration in FIG. 11, the handle load point 180 is located on the elongate central portion 164 of the handle 114 proximate the forward portion 160. Similar to the razor configuration shown in FIG. 10, the handle roll axis 136 extends between the free end of the rear portion 162 of the handle 114 and the point of equilibrium 148 on the razor cartridge 112. However, as shown in FIG. 11 and FIG. 11*a*, for this embodiment the handle roll axis 136 nearly intersects the handle load point 180. For instance, the handle roll axis 136 intersects or is slightly below the handle load point 180 such that the distance between the handle load point 180 and the handle roll axis 136 is less than 10 mm. Preferably, the distance between the handle load point 180 and the handle roll axis 136 is less than 8 mm. More preferably, the distance between the handle load point 180 and the handle roll axis 136 is less than 5 mm. As a result, for a simply supported grip the handle configuration is nearly balanced and does not have propensity to roll or spin about the handle roll axis 136. In addition, since distance between the load point 180 and the handle roll axis 136 is minimal, minimal eccentric load is produced at the load point 180 relative to the handle roll axis 136 producing a moment that induces roll. As a result, the configuration presents a conditionally stable configuration since a user does not have to compensate for instability induced by imbalance or eccentric loads during use.

For the embodiment in FIG. 11, the forward portion 160 of the handle 114 is offset from the longitudinal axis 130 such that the point of intersection 172 of the projection of the longitudinal axis 130 with the cutting plane 122 is forward of the point of equilibrium 148 on or near the front edge portion 140 of the cartridge 112 forming a Z-shaped portion having an upper portion 192 and a lower portion 194 and central portion 198 therebetween. The upper portion 192 forms the handle mounting structure 111 and the lower portion 194 joins the elongate central portion 164.

Figure 1:
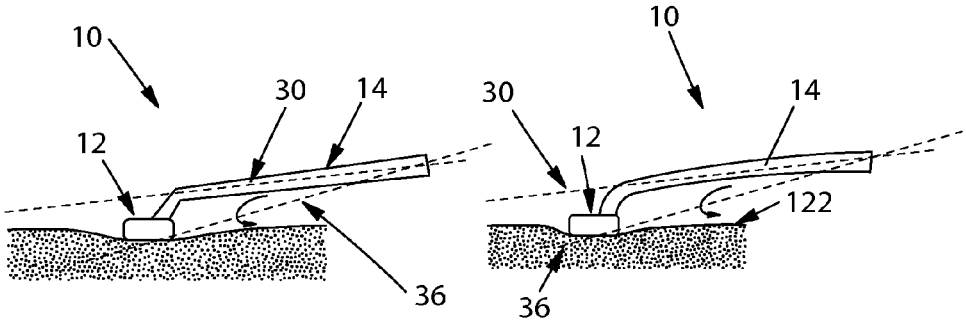
Fig. 1 (Prior Art)
FIG. 1 is side views of prior art shaving razor handle configurations.

Other configurations providing the forward portion 160 of the handle that is offset from the longitudinal axis 130 of the handle are contemplated. For instance, in an alternate embodiment shown in FIG. 12, the forward portion 260 of the handle 214 can be offset from the longitudinal axis 230 forming an 'L' shape. For this embodiment, the longitudinal axis 230 of the elongate central portion 264 of the handle 214 nearly coincides with the axis of roll 236 extending from the free end of rear portion 262 and the point of equilibrium 248. Unlike the L-shape configuration of the prior art shown in FIG. 1, for the L-shape configuration shown in FIG. 12, the forward portion 260 is offset such that the projection of the longitudinal axis 230 intersects the cutting plane 122 at the point of intersection 272 which is forward of the point of equilibrium 248 of the cartridge 112.

In another embodiment, the forward portion of the handle can be offset from the longitudinal axis forming an arcuate shape having a convex upper surface and a concave lower surface. For this embodiment, the arcuate shaped forward portion can be offset for the elongate central portion of the handle such that the projection of the longitudinal axis intersects the cutting plane forward of the point of equilibrium on the cartridge.

Figure 12:
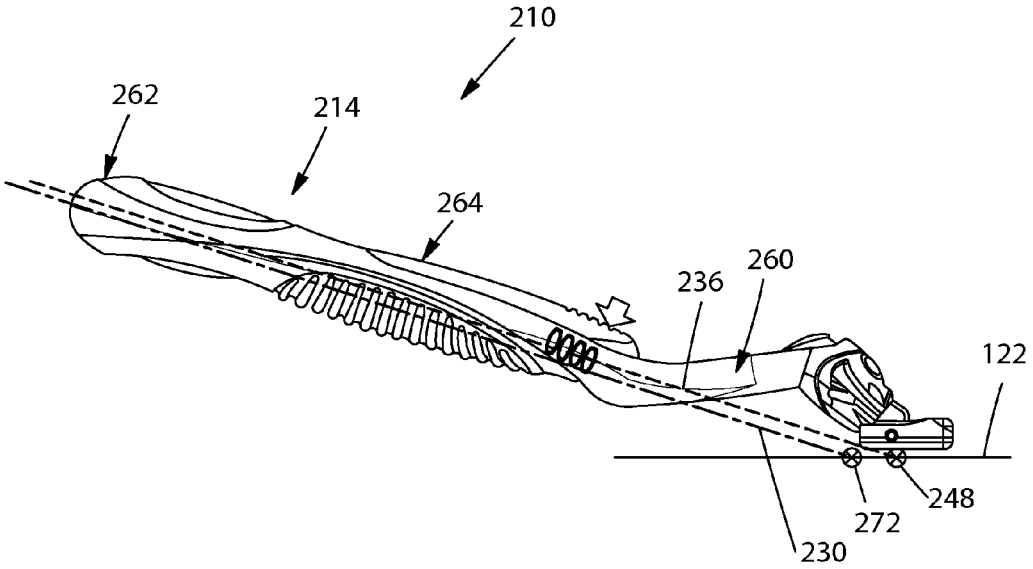
FIG. 12 is a side view of a shaving razor handle configuration showing handle roll axis proximate the handle load point and the projection of the longitudinal axis of the handle intersecting the cutting plane forward of the razor cartridge.
Figure 13:
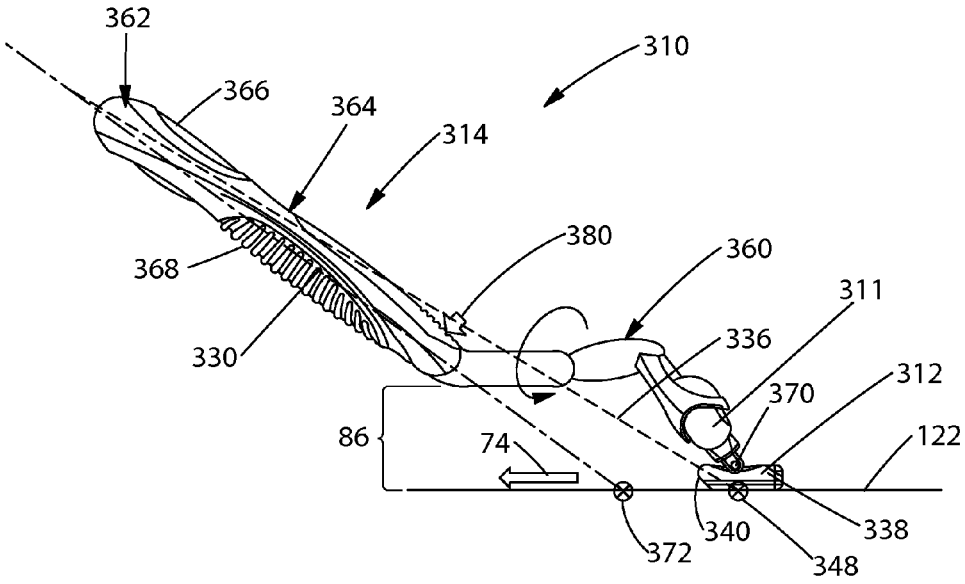
FIG. 13 is a side view of a shaving razor handle configuration showing handle roll axis proximate the handle load point and the projection of the longitudinal axis of the handle intersecting the cutting plane forward of the razor cartridge.

FIG. 13 illustrates a handle configuration according to the present invention which is unconditionally stable. Referring to FIG. 13, the forward portion 360 of the handle 314 is offset from the elongate central portion 364 such that the handle load point 380 is below the handle roll axis 336. As shown, shaving razor 310 includes a handle 314 including a forward portion 360 comprising a handle mounting structure 311, a rear portion 362 opposite the forward portion 360 comprising a free end and an elongate central portion 364 disposed between the forward portion 360 and the rear portion 362. The elongate central portion includes an upper surface 366, a lower surface 368 and a longitudinal axis 330 disposed therebetween. A projection of the longitudinal axis 330 intersects the cutting plane 122. The shaving razor 310 includes a point of equilibrium 348 on the cutting plane 122 which is aligned with the cartridge pivot axis 370 providing a balanced axis of rotation. Similar to the handle configuration in FIGS. 11 and 12, the point of intersection 372 for the razor in FIG. 13 is forward of the point of equilibrium 348; however, for this configuration the point of intersection 372 leads the front edge portion 340 of the cartridge 312. Preferably the point of intersection 372 leads the point of equilibrium 348 by less than 10 mm.

Figure 13A:
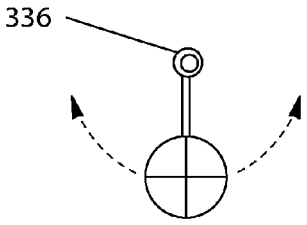
FIG. 13*a* illustrates the effects of loads applied to the handle of FIG. 12.

The handle load point 380 is located on the elongate central portion 364 of the handle 314 proximate the forward portion 360. The shaving razor 310 includes a handle roll axis 336 extending between the free end of the rear portion 362 of the handle 314 and the point of equilibrium 348 on the cartridge 312. As shown in FIG. 13, the handle load point 380 is below the handle roll axis 336. For a simply supported grip, the configuration is illustrated by the pendulum analogy shown in FIG. 13*a* where the pendulum and corresponding center of gravity is below the pivot axis 336. When the pendulum is displaced from its resting equilibrium position, it is subject to a restoring force due to gravity that will accelerate it back toward the equilibrium position. Similar to the pendulum, when an eccentric load is applied to the load point 380 in FIG. 13 the handle 314 is displaced from its equilibrium position and a restoring force applied to load point 380 by the user's forefinger returns the handle to its equilibrium position. As a result, since instability induced by eccentric loads can be counteracted by a forefinger restoring force, the design provides an unconditionally stable configuration.

In addition to the simply supported grip previously described, users are also known to grip a razor handle 14 at the handle load point 80 in a tripod grip that applies a moment force similar to the way a writer grips a pencil. For instance in a tripod grip a user can grip the elongate central portion 64 around the handle load point 80 with the forefinger positioned on the load point 80 and the thumb pad and side of the middle finger positioned along the sides of the elongate central portion 64 adjacent the load point 80 so that equal pressure is applied by the forefinger, thumb pad and side of the middle finger. For the tripod grip, the handle 14 shown in FIG. 10 has a tendency to spin or roll about the longitudinal axis 30 of the elongate central portion 64 and the fingers apply a moment $M_{hand}$ at the handle load point 80 to counteract the forces that induce the spin. For the tripod grip, $M_{hand}$ also steers the razor cartridge.

In addition to improving the stability of the razor by minimizing or eliminating moments that induce roll about the handle axis of roll when securing the razor handle with the simply supported grip, the offset in the handle configuration according to the present invention can improve a user's control of the razor by enhancing the ability to guide or steer the razor cartridge particularly when using the tripod grip. The improvements to control can be explained in terms of dynamic loading.

For instance, it is well known that it is easier to direct or steer a load that is pulled by a force than it is to direct or steer a load that is pushed by a force. The projection of the longitudinal axis 30 of the prior art shaving razor 10 shown in FIG. 10 intersects the cutting plane 122 at a point of intersection 72 that lags the point of equilibrium 48 of the shaving cartridge 12. As a result, the razor cartridge 12 is pushed through a shaving stroke. In comparison, the offset produced in the handle configurations illustrated in FIGS. 11-13 each include a point of intersection (172, 272, 372) between the projection of longitudinal axis (130, 230, 330) of the elongate center portion (164, 264, 364) and the cutting plane 122 that leads the point of equilibrium (148, 248, 348) on the cartridge (112, 212, 312). As a result, the cartridges in FIGS. 11-13 are pulled making it easier to direct or steer the razor cartridges through a shaving stroke.

The effects that handle geometry can have on guiding the razor cartridge through a shaving stroke can be further explained using a kinematics analogy and dynamic loads involved in steering a wheel. For steering a wheel, pivot points are angled such that a steering axis drawn through the pivot points intersects the road surface slightly ahead of the point where the wheel contacts the road. The purpose of this is to provide a degree of self centering for steering the wheel where the wheel casters around so as to trail behind the axis of steering. This makes the vehicle easier to drive and improves its directional stability by reducing its tendency to wander.

Caster angle is defined as the angle between the steering axis and the vertical plane as viewed from the side of the wheel. Positive caster is the distance between the wheels contact point and the point at which the steering axis intersects the road ahead of the contact point as viewed from the side. Caster determines the degree of self centering action in the steering as well as influences straight line stability and steering force in curves. Excessive caster will make steering heavier and less responsive through curves necessitating the need for additional force in order to turn.

Comparing a steering axis, contact point and caster of a wheel to the shaving razor 110 in FIG. 11, the longitudinal axis 130 of the razor handle 114 projected onto and intersecting the cutting plane 122 at the point of intersection 172 can represent a steering axis of the shaving razor 110, the point of equilibrium 148 on the cartridge 112 intersecting the cutting plane 122 can represent the razor cartridge contact point and the distance between the point of intersection 172 and the cartridge point of equilibrium 148 can represent the caster of the shaving razor 110. Similar to a wheel, the handle configuration in FIG. 11 has a positive caster providing a self-centering effect that makes it easier to guide the cartridge 112 through shaving strokes. In contrast, the handle configuration shown in FIG. 10 has a negative caster and therefore, does not have a self centering effect, thus, requiring more force to steer the cartridge 112 through shaving strokes. Also, similar to reduced responsiveness associated with steering a wheel having excessive caster, a razor cartridge having excessive castor can be difficult to control particularly around curves since more force is required to turn the cartridge.

For the shaving razor of the present invention, a caster distance in excess of 10 mm has been found to make it difficult to maneuver the razor cartridge around corners. For this reason the point of intersection of the longitudinal axis leads the point of equilibrium by a distance which is less than 10 mm. Preferably the distance between the point of intersection and the point of equilibrium is between about 2 mm and about 10 mm. More preferably the caster distance is between about 2 mm and about 5 mm.

Figure 14:
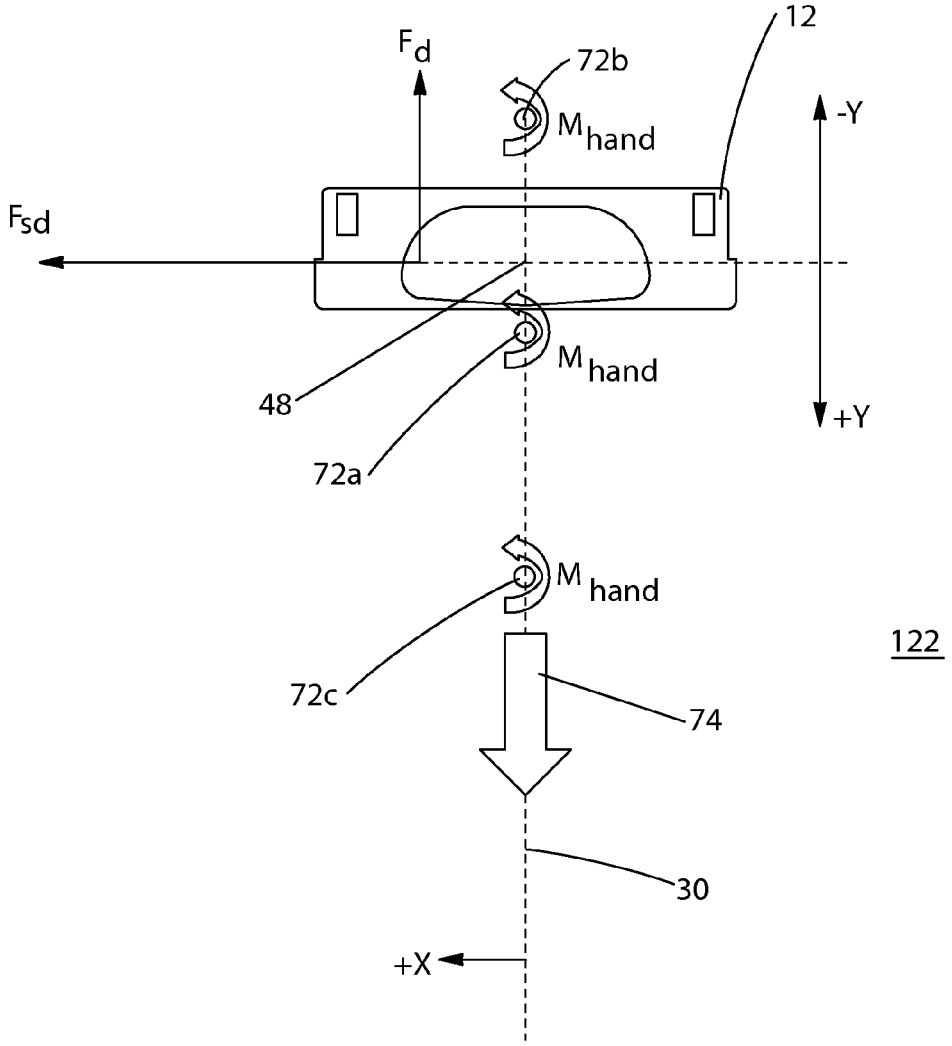
FIG. 14 is a force diagram illustrating moments induced by out of balance drag force, $F_d$, and drag resistance to sideways rotation, $F_{sd}$.

The impact that the handle configuration can have on the ability to steer the razor cartridge 12 using the tripod grip, particularly through turns, is further demonstrated in the diagram in FIG. 14. As shown in FIG. 14, an out of balance drag force, $F_d$, and drag resistance to sideways rotation, $F_{sd}$, produce moments $F_dX$ and $F_{sd}Y$ about the handle longitudinal axis 30. As shown, X is the distance from the resultant drag force $F_d$ to the point of equilibrium 48 on the razor cartridge 12 and Y is the distance from the point of intersection 72 of the projection of the handle longitudinal axis 30 with the cutting plane 122 to the point of equilibrium 48 on the razor cartridge 12.

$M_{hand}$ is a moment applied at the handle load point previously described needed to counteract the moment induced by the out of balance drag force, $F_d$, and the drag resistance to sideways rotation, $F_{sd}$ that induce a moment about the longitudinal axis 30 of the handle 14. $M_{hand}$ is also the moment required to steer the cartridge 12.

For a handle in equilibrium, summing the moments about the handle longitudinal axis point of intersection 72*a* forward of the razor cartridge in the shaving direction indicated by +Y results in the following expression:

$$M_{hand}=F_dX-F_{sd}Y \tag{1}$$

where $M_{hand}$—the moment applied at the handle load point.

$F_d$—out of balance drag force.

$F_{sd}$—drag resistance to sideways rotation.

X—is the distance from the resultant drag force Fd to the point of equilibrium 48 on the razor cartridge 12.

Y—is the distance from the point of intersection 72*a* of the projection of the handle longitudinal axis 30 with the cutting plane 122 to the point of equilibrium 48 on the razor cartridge 12. (+Y is in the shaving direction 74; −Y is opposite the shaving direction 74)

($F_d$ and $F_{sd}$ are typically about equal; therefore, the moment required to maintain equilibrium is dependent on the ratio of X/Y.)

This shows that for positive +Y the out of balance force, $F_d$, and the drag resistance to sideways rotation, $F_{sd}$, work in opposition; therefore, reducing the counter moment, $M_{hand}$, needed to counteract the moments induced on the handle during a shaving stroke. As a result, the cartridge is easier to steer.

Alternatively, it can be seen that a handle configuration having a handle longitudinal axis that intersects the cutting plane at a point of intersection 72*b* that is behind the point of equilibrium 48 on the razor cartridge 12 relative to the cutting direction 74 increases the counter moment, $M_{hand}$, needed to counteract the moments induced by drag forces $F_a$ and $F_{sd}$ during a shaving stroke. As shown in FIG. 14, the point on intersection 72*b* of the longitudinal axis 30 falls a negative distance, −Y, behind the point of equilibrium 48 as shown in FIG. 14; therefore, the drag resistance to sideways rotation, $F_{sd}$, induces a moment that is in the same direction as the moment induced by the drag force $F_d$. Therefore, a counter moment, $M_{hand}$, about the handle axis 30 is needed to overcome the moment induced by both the out of balance drag force, $F_d$, and the sideways drag component, $F_{sd}$. As a result, it is more difficult to steer a handle configuration having a handle axis intersecting the cutting plane at a point of intersection 72*b* behind the point of equilibrium 48 on the razor cartridge 12 than a handle configuration where the longitudinal axis 30 intersects the cutting plane at a point of intersection 72*a* that is forward of the point of equilibrium 48 on the razor cartridge 12.

Figure 15:
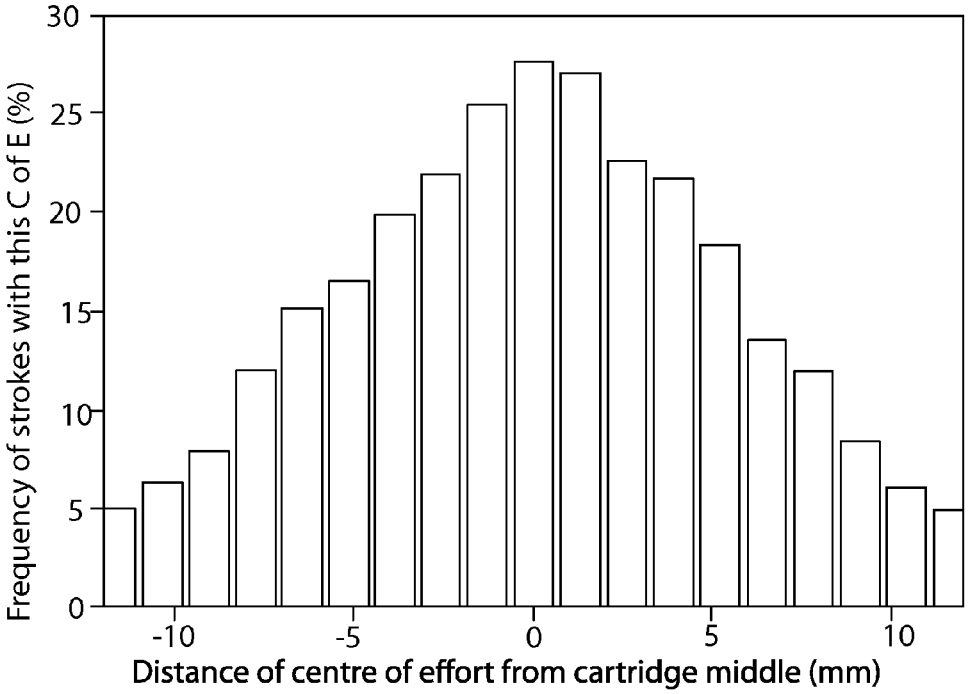
FIG. 15 illustrates the distribution of load imbalance as a percentage of total loads measured.

The histogram in FIG. 15 illustrates the distribution of load imbalance as a percentage of total loads across 12 panellists at 2 shaves per panellist. The drag imbalance is assumed to be proportional to the load imbalance attributed to loads normal to the shaving plane. Normal load forces are measured using a load cell with 2 axes in the normal load direction separated by 26 mm. Each load cell arm is 13 mm from the center of the cartridge. An apparatus for measuring loads on a razor cartridge is described in US Patent Application Publication 2008/0168657 A1.

100% load imbalance occurs when the entire measured load is above one load cell arm indicated by the arrows shown in FIG. 15. Center of effort is the point where resultant of forces due to normal loads occurs along the cartridge length. The histogram shows less than 5% have 100% load imbalance. For a cartridge of nominal cartridge width of 40 mm, 90% of the load imbalance falls within 10 mm from the center of the cartridge.

Applying this to equation 1 above, X will have a maximum distance of about 10 mm. Thus, referring to FIG. 14, in order to minimize the amount of counter torque, $M_{hand}$, required to be applied by the hand, the distance Y from the center of the cartridge 12 to the point of intersection 72*c* that the handle longitudinal axis 30 makes with the cutting plane should be 10 mm or less. Further increasing the distance Y beyond 10 mm will result in an increase in $M_{hand}$ in the opposite direction to counter the increase in drag resistance to sideways rotation, $F_{sd}$.

In addition, another disadvantage of further increasing Y is that it will reduce the speed at which a user can rotate the cartridge to steer for a given moment as shown below in equations (2) and (3). For this example, for simplicity, the drag force, $F_d$, is assumed to be balanced and therefore, $F_d$=0. As shown in equation (3), the angular velocity $\dot{\theta}$ decreases as Y increases.

$$M_{hand} - F_{sd}Y = m_{cart}\ddot{\theta}_{cart} \tag{2}$$

$$\dot{\theta} = \frac{1}{m_{cart}}\int M_{hand} - F_{sd}Y\,dt \tag{3}$$

where $\ddot{\theta}_{cart}$—Angular acceleration of the cartridge $\dot{\theta}$—Angular velocity of the cartridge $m_{cart}$—the cartridge mass.

$M_{hand}$—the moment applied by the hand.

Fsd—drag resistance to sideways rotation.

Thus, minimizing the distance Y that the point of intersection 72*c* leads the point of equilibrium 48 reduces the impact that $F_{sd}$ has on reducing the angular velocity and corresponding ability to steer the cartridge through turns.

In addition to affecting the ability to steer the cartridge, particularly through turns, handle configurations like the one shown in FIG. 13 having a point of intersection 372 that leads the point of equilibrium 348 by an excessive amount can also affect the ergonomics of the handle. This is due to the potential for the lower surface 368 of the elongate central portion 364 near the forward portion 360 of the handle 314 to make contact with a user's skin during a shaving stroke. In order to prevent the lower surface 368 of the handle 314 from contacting the skin, the clearance distance 86 between the lower surface 368 of the forward portion of the elongate central portion 364 of the handle 314 and the cutting plane 122 ranges between 5 mm and 15 mm when the cartridge is resting against the skin in a neutral position. Since the clearance distance 86 is dependent on the orientation of the elongate central portion 364 of the handle 314, it correlates to the distance that the point of intersection 372 of the projection of the longitudinal axis 330 of the elongate central portion 364 leads the point of equilibrium 348 in the cutting direction 74. For the configuration shown in FIG. 13 a point of intersection 372 that leads the point of equilibrium 348 by less than about 10 mm can result in a clearance distance 86 of less than 15 mm and preferably between 5 mm and 15 mm.

Regarding all numerical ranges disclosed herein, it should be understood that every maximum numerical limitation given throughout this specification includes every lower numerical limitation, as if such lower numerical limitations were expressly written herein. In addition, every minimum numerical limitation given throughout this specification will include every higher numerical limitation, as if such higher numerical limitations were expressly written herein. Further, every numerical range given throughout this specification will include every narrower numerical range that falls within such broader numerical range and will also encompass each individual number within the numerical range, as if such narrower numerical ranges and individual numbers were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor providing enhanced control during shaving, the shaving razor comprising:

a. a cartridge comprising:

1) a cartridge housing having a front edge portion, a rear edge portion and two opposing side edge portions extending from the front edge portion to the rear edge portion;

2) at least one shaving blade disposed between the front edge portion and the rear edge portion;

3) a cutting plane tangent to the rear edge portion and the front edge portion of the cartridge housing with a forward cutting direction toward the front edge portion of the cartridge; and 4) a point of equilibrium intersecting the cutting plane and balancing the forward portion and the rear portion of the cartridge;

and b. a handle comprising:

1) a forward portion comprising a cartridge mounting structure;

2) a rear portion opposite the forward portion comprising a free end;

3) an elongate central portion disposed between the forward portion and the rear portion, the elongate central portion having an upper surface and a lower surface and a longitudinal axis disposed therebetween, wherein a projection of the longitudinal axis intersects the cutting plane at a point of intersection, wherein the point of intersection leads the point of equilibrium in the cutting direction by a distance of less than 10 mm.

2. The shaving razor of claim 1 wherein the point of intersection leads the point of equilibrium in the cutting direction by a distance of less than 5 mm.

3. The shaving razor of claim 1 wherein the forward portion of the handle is offset forming an L-shaped portion wherein the point of intersection of the projection of the longitudinal axis is forward of the cartridge in the cutting direction.

4. The shaving razor of claim 1 wherein the forward portion of the handle is offset forming a Z-shaped portion.

5. The shaving razor of claim 1 wherein the razor cartridge includes a guard disposed on the front edge portion and a cap disposed on the rear edge portion and two or more blades with parallel cutting edges mounted therebetween.

6. The shaving razor of claim 1 wherein the razor cartridge comprises a cartridge pivot axis aligned with the point of equilibrium providing a balanced axis of rotation of the cartridge about the handle.

7. A shaving razor providing enhanced stability and control during shaving, the shaving razor comprising:

a. a cartridge comprising:

1) a cartridge housing having a front edge portion, a rear edge portion and two opposing side edge portions extending from the front edge portion to the rear edge portion;

2) a shaving blade disposed between the front edge portion and the rear edge portion;

3) a cutting plane tangent to the rear edge portion and the front edge portion of the cartridge housing with a forward cutting direction toward the front edge portion of the cartridge; and 4) a point of equilibrium intersecting the cutting plane and balancing the forward portion and the rear portion of the cartridge;

and b. a handle comprising:

1) a forward portion comprising a cartridge mounting structure;

2) a rear portion opposite the forward portion comprising a free end;

3) an elongate central portion disposed between the forward portion and the rear portion, the elongate central portion having an upper surface and a lower surface and a longitudinal axis disposed therebetween, wherein a projection of the longitudinal axis intersects the cutting plane at a point of intersection, wherein the point of intersection leads the point of equilibrium in the cutting direction by a distance of less than 10 mm;

4) a handle load point on the upper surface of the elongate central portion proximate the forward portion; and 5) a handle roll axis between the point of equilibrium and the free end of the rear portion; wherein the handle roll axis intersects or is less than 5 mm below the handle load point.

8. The shaving razor of claim 7 wherein the longitudinal axis of the handle is parallel to the handle roll axis.

9. The shaving razor of claim 7 wherein the longitudinal axis of the handle coincides with the handle roll axis.

10. The shaving razor of claim 7 wherein the point of intersection leads the point of equilibrium in the cutting direction by a distance of less than 5 mm.

11. The shaving razor of claim 7 wherein the razor cartridge comprises a cartridge pivot axis aligned with the point of equilibrium providing a balanced axis of rotation of the cartridge about the handle.

12. The shaving razor of claim 11 wherein the shaving blade comprises a cutting edge wherein the cartridge pivot axis is forward of the cutting edge.

13. The shaving razor of claim 11 wherein the shaving blade comprises a cutting edge wherein the cartridge pivot axis is aligned with the cutting edge.

14. The shaving razor of claim 7 wherein the handle roll axis intersects the handle load point.

15. The shaving razor of claim 7 wherein the handle roll axis is above the handle load point.

16. The shaving razor of claim 15 further comprising a clearance distance between the lower surface of a forward portion of the elongate central portion of the handle and the cutting plane ranging between 5 mm and 15 mm when the cartridge is resting against skin in a neutral position.

* * * * *